United States Patent [19]

Möltner et al.

[11] 4,323,971

[45] Apr. 6, 1982

[54] ADJUSTMENT MEANS FOR STRETCH REDUCTION ROLLING MILLS

[75] Inventors: Hermann Möltner, Düsseldorf; Wolfgang Siebenborn, Dormagen, both of Fed. Rep. of Germany

[73] Assignee: Kocks Technik GmbH & Co., Düsseldorf, Fed. Rep. of Germany

[21] Appl. No.: 102,411

[22] Filed: Dec. 11, 1979

[30] Foreign Application Priority Data

Nov. 27, 1979 [DE] Fed. Rep. of Germany ..... 2947233

[51] Int. Cl.[3] ..... G06F 15/46; B21B 37/00

[52] U.S. Cl. ..... 364/469; 72/12; 72/16; 72/17; 364/472

[58] Field of Search ..... 364/472, 468, 469; 72/8, 9, 11, 12, 16, 17, 205, 289, 277, 279, 367

[56] References Cited

U.S. PATENT DOCUMENTS 3,074,300 1/1963 Justus ..... 72/29

3,766,761 10/1973 Adair et al. ..... 72/8

3,874,211 4/1975 Hayashi ..... 72/19 X 4,002,048 1/1977 Pozsgay ..... 72/205

4,086,800 5/1978 Demny et al. ..... 72/205

*Primary Examiner*—Joseph F. Ruggiero

*Attorney, Agent, or Firm*—Buell, Blenko, Ziesenheim & Beck

[57] ABSTRACT

An adjustment device is provided for regulating the total degree of drawing in a multi-stand stretch reduction rolling mill for the stretch reduction of tube having a digital unit which calculates intermittently the desired or theoretical stretchings (λ theor.) from the entering and exiting wall thicknesses ($S_o$, S) and the external diameters ($D_o$,D) of both the actual entering and desired finished tube sections and continuously the actual stretchings (λ act.) from the entrance and exit speeds ($V_o$,V) of the tube, and a regulator adjusting the roll r.p.m.'s as a function of the differences in theoretical and actual stretchings (Δλ).

8 Claims, 3 Drawing Figures

ADJUSTMENT MEANS FOR STRETCH REDUCTION ROLLING MILLS

This invention relates to adjustment means for stretch reduction rolling mills and particularly to an adjustment device for regulating the total degree of drawing of a stretch reduction rolling mill.

Stretch reduction rolling mills are frequently used for the production of tubes for use in a variety of purposes. In general, it is desired that such tubes be produced with a uniform or constant external diameter and a uniform or constant wall thickness.

The variation in tube wall thickness in a stretch-reduction rolling mill is essentially dependent on the tractive force that acts in the tube in the longitudinal direction during the diameter reduction. If the tube is reduced without a tractive force, the wall thickness increases during a diameter reduction. If the roll r.p.m.'s are varied such that a tractive force acts on the tube between the roll stands, with a constant diameter reduction and increasing tractive force the wall thickness increase is first reduced, then the wall thickness remains the same, and finally it decreases with a correspondingly high tensile stress on the tube. Thus, if one wishes to obtain finished tube with constant external diameter and constant wall thickness, not only is a constant pass opening of the roll stand or stands on the delivery side required, but a precisely regulated total traction and total degree of drawing of the rolling mill are primarily necessary.

If the tubes entering into the stretch-reduction rolling mill are mutually identical in their diameter and wall thickness and also identical over their length, a quite specific total degree of drawing can be calculated, which needs only to be adjusted and maintained with the necessary precision, in order to obtain finished tubes with a constant external diameter and a constant wall thickness of the desired size. In general, however, the entering tubes do not meet these requirements; therefore, an attempt is made to equalize the diameter, but primarily to control the wall thickness deviations of the entering tube in the stretch-reduction rolling mill. While a constant external diameter of the tube can be relatively easily obtained with the roll designing, the wall thickness must be maintained constant by appropriate variation of the total degree of drawing.

For this purpose, an adjustment device is required for regulating the total degree of drawing. The present invention concerns such an adjustment device for regulating the total degree of drawing of a multi-stand stretch-reduction rolling mill for the reduction of tubes, with which the degree of drawing can be adjusted as a function of the entrance measurements of the mean wall thicknesses of the tube in order to obtain the desired constant finished tube wall thickness.

Such an adjustment device is known from the German Pat. No. 1,427,922. It proved to be quite useful, but practical application necessitates an improvement in this familiar adjustment device. The reason for this resides primarily in the increasingly stringent requirements imposed on the dimensional precision of the finished tubes. The maintenance of an increased dimensional precision in practice frequently goes beyond the requirements of the industry norms. Its first purpose is to produce finished tube of special quality and, secondly, to shift the actual finished dimensions ever closer to the minimum measurements that are still permissible according to the pertinent norms; thus, as many meters of finished tube as possible can be produced from each ton of material used. The indicated purposes, i.e., quality improvement and an increase in the yield, require a precise maintenance of the tube wall thickness.

The familiar adjustment device does take into account the fact that the entering tubes have nonuniform wall thicknesses because it operates as a function of the entrance measurements of the mean wall thicknesses of the tube. However, the familiar adjustment device lacks the reverse control over the outcome of an adjustment of the total degree of drawing and the possibility of a renewed correction of the adjustment after this reverse control. In addition, a continuous regulation of the total degree of drawing takes place in this familiar adjustment device and it thus happens that the tube sections are affected by a regulation step for which it was not intended.

The purpose of the present invention is to improve the familiar adjustment device so that the adjusted total degree of drawing is more precisely adapted to the individual tube sections as they enter the stretch-reduction rolling mill.

This problem is resolved in accordance with the present invention in that a digital unit is provided, which calculates the theoretical stretchings from the wall thicknesses and external diameters of both the actually entering and also the desired finished tube section intermittently and the actual stretchings from the entrance and exit speeds of the tube continuously, and that a regulator that adjusts the r.p.m.'s of the rolls as a function of the differences in the theoretical and actual stretchings is present in a control loop.

It is thus achieved that a reverse control is carried out on the outcome of the adjustment of the total degree of drawing, in which the actual stretching is continuously compared with the theoretical stretching. Deviations in the two stretching values with regard to each other induce, in accordance with the magnitude, a corresponding readjustment of the roll r.p.m.'s in the sense of a suitable variation in total degree of drawing, such that the actual stretching matches the theoretical stretching. The total degree of drawing is thus adjusted not only as a function of the entrance dimensions of the wall thickness as in the familiar design, but also as a function of the differences between the actual and theoretical stretchings. A more precise regulation of the total degree of drawing is thus achieved. This degree is also assigned to the correct tube length sections because it is calculated separately for each. This is primarily true for the stationary operating state, in which the beginning of the tube has passed the stretch-reduction rolling mill and the subsequent measuring devices, while the tube end section has not yet reached the measuring devices on the entrance side and the first roll pass.

The digital unit determines the theoretical stretchings from the quotients of first-pass cross section and finished cross section, which result from the corresponding wall thickness and diameter of the tube. The theoretical stretching is thus obtained as follows:

$$\lambda_{theor.} = S_o/S \cdot D_o - S_o/D - S$$

where $S_o$ is the first-pass wall thickness, S is the finished wall thickness, $D_o$ the first-pass diameter, D the finished diameter, and $\lambda_{theor.}$ the theoretical stretching. Because the finished wall thickness S and the finished diameter D are precise desired values, they are not measured, but fed directly to the computer. The first-pass wall thickness, which frequently fluctuates, is measured on the entrance side in front of the first roll stand. The first-pass diameter $D_o$ can also be fed in as a fixed value if it is determined with certainty that the diameter of the entering tube fluctuates only very slightly and is essentially constant, which is the case in practice, e.g., with superposed tube welding installations with calibrating stands. However, if there is the danger that the first-pass diameters fluctuate, it is recommended that they be measured on the entrance side. The measurement values are fed to the digital unit, which calculates the theoretical stretching $\lambda_{theor.}$ from them, together with the values fed in.

The actual stretching $\lambda_{act.}$ is also determined by the computer, i.e., measured from the entrance speed $V_o$ by a speed-measuring device in front of the first roll stand and the exit speed V measured by a speed-measuring device beyond the last roll stand. The actual stretching $\lambda_{act.}$ is obtained from the quotient of the two values. The difference $\Delta\lambda$ is deduced from the theoretical and actual stretchings and the total degree of drawing is modified in accordance with the magnitude of this difference through the roll r.p.m.'s such that a compensation between theoretical and actual stretching is effected. The computer and measuring devices used in this connection are familiar in themselves.

It is essential that the actual stretchings be determined continuously while the theoretical stretchings are determined intermittently only for a specific tube length section. A continuous adjustment of the total degree of drawing for every minor irregularity is thus avoided and a certain compensation for rapid successive measurement deviations in the entering tube is achieved.

In a preferred implementation of the invention, the mean wall thicknesses of the successive tube sections can be measured with the wall thickness measuring device on the entrance side. The lengths of these sections correspond to the tube volume in the controlled system of the rolling mill, which extends from the first to the last of the passes, between which the tube is loaded with the full traction in the stationary operating state, and the intermittent theoretical stretchings are determined, using this mean wall thickness for such a tube section. In a theoretical value determination of this type the fact is taken into account that only a given tube section, which is under the full influence of the traction in the rolling mill, is affected by the stretching variations, while the tube sections in the traction-building front roll stands and in the traction-fading rear roll stands, in the region of which the tube is not subjected to the full traction, undergo no variation in traction.

It is particularly advantageous if a theoretical stretching of a tube section is the guide value of the regulator in the control loop from then on, if the middle of this tube section has reached the controlled zone, i.e., the first pass, between which the tube is loaded with the full traction in the stationary operating state. Each theoretical stretching determined is accordingly the guide value of the regulator until the theoretical stretching of the subsequent tube section replaces it in an identical manner, that is, the middle of the subsequent tube section has reached the beginning of the control zone. The stretching in the middle of such a tube section is accordingly guided during passage through the control zone of the rolling mill by only a single, constant theoretical value, which is calculated in accordance with the mean value of the wall thicknesses of this tube section measured on the entrance side. Thus, the theoretical stretching of a tube section is used with a time delay as the guide value of the regulator, namely, at a point in time when half of the tube section has already entered into the control zone. This presents the advantage that the influences of the successive theoretical stretching values overlap. In spite of a stepwise theoretical value determination, this overlapping induces a continuous transition in the stretching achieved. In the case of a uniform wall variation from one tube section to the other, the overlapping of the influences of the individual theoretical stretchings leads to a uniform finished wall thickness.

In order to determine the actual stretching, both the entrance and exit speeds of the tube are required. An actual stretching can thus be calculated only if both speed-measuring devices are in operation, i.e., the stationary operating state is prevailing. With non-stationary operating states, i.e., when the beginnings of the tubes are entering and the tube ends are emerging, no actual stretching can be determined for a substantial tube section, because either the speed-measuring device on the exit side or the one on the entrance side furnishes no values because the tube is still absent there. For this operating state of the rolling mill and the adjustment device it is recommended that the regulator setting determined last be stored and continue to be used. This solution is expedient if the wall thickness difference between the entering tubes is small or if the wall thickness has only a very slow tendency to vary. Such a storage and continued use of the last regulator setting based on measured values is also sufficient in the case of very large tube lengths, such as those in superposed tube welding installations.

In the nonstationary operating state it is possible according to another embodiment of the invention during the entrance of a tube beginning and the emergence of a tube end until a stationary operating state is achieved to store the actual stretching of the previously rolled tube section and compare it with the newly calculated theoretical stretching of an entering or emerging tube beginning or end, and to control the roll r.p.m.'s and thus the total degree of drawing as a function of the differences in these theoretical and actual stretchings. The fact that during the entrance of the beginning of a tube the theoretical stretching can be determined as in the stationary operating state, but not the actual stretching, is utilized here. If the newly calculated theoretical stretching is used during the entrance of a tube beginning, a more precise adjustment of the total degree of drawing is achieved in many cases than with a regulator setting corresponding completely to the value of the preceding tube and which does not take into account the theoretical stretching that can be newly determined.

On the other hand, it is particularly advantageous if a control system with a control computer is assigned to the regulator and the control loop, with which the dependence of the actual regulator settings on the measured initial wall thicknesses and possibly also the initial diameters can be calculated and stored during operation of the control loop in the stationary operating state, and that the roll r.p.m.'s and thus the total degree of drawing can be controlled with the control system on the basis of the stored data from the control computer in the case of an interrupted control loop in the nonstationary operating state. The control computer thus operates in the stationary operating state and calculates from the r.p.m. and/or total drawing degree settings of the regulator the dependence of these settings on the values measured on the entrance side. The control computer thus learns and stores this dependence and arrives at a control law. According to this control law, the rolling mill is controlled during the period in which the control loop is interrupted, even though one of the speed-measuring devices no longer furnishes any data and therefore no actual stretching values based on measurements are available.

The invention is illustrated in the drawings on the basis of schematic presentations, where:

Figure 1:
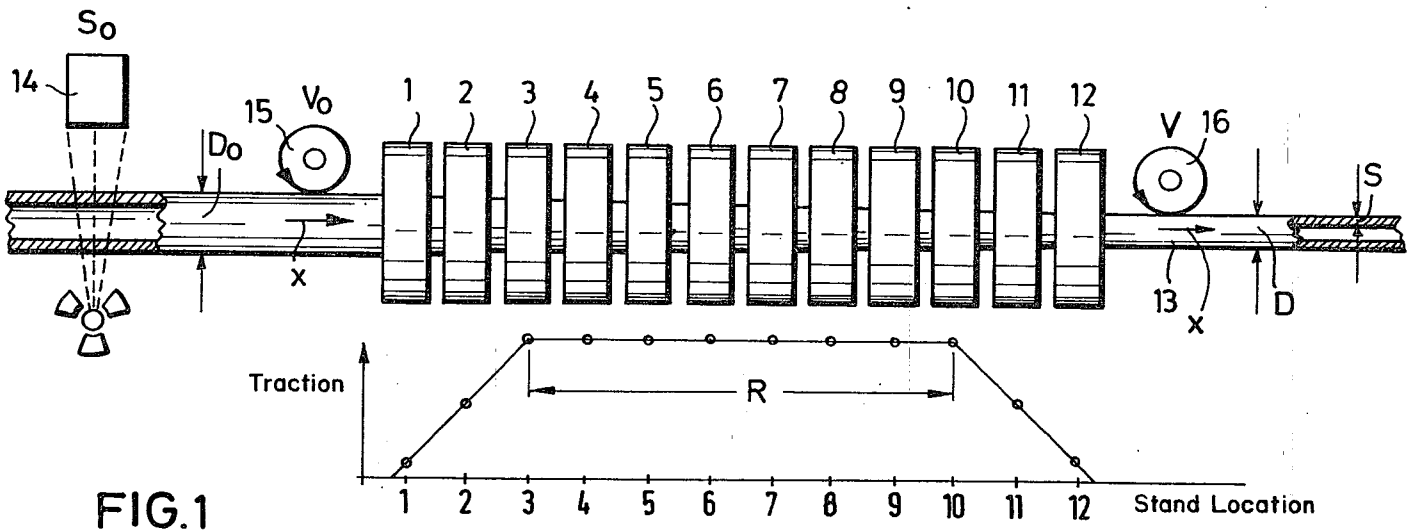
FIG. 1 shows a stretch-reduction rolling mill with the arrangement of measuring devices for the adjustment arrangement according to the invention.

The roll stands of a stretch-reduction rolling mill are designated in FIG. 1 by 1–12, into which a tube 13 has entered. The tube 13 moves in the arrow direction X through the stretch-reduction rolling mill, which can have a completely different number of roll stands. A wall thickness measuring device 14 is provided on the entrance side; for example, it can consist of an isotope radiation meter. This measures the wall thickness $S_o$ of the tube 13 upon entrance. A speed-measuring device 15, which can consist of a measuring wheel that is connected to an impulse transmitter, measures the entrance speed $V_o$ of the tube 13. The external diameter $D_o$ of the tube 13 can also be measured at the entrance side. In many cases, however, it is sufficient to feed this external diameter $D_o$ in as a fixed value. The external diameter D and the wall thickness S of tube 13 on the emergence side are also fed in as fixed values. Therefore, these three values are represented in FIG. 1 only with arrows. It is obvious that these values should also be modified in the case of changes in the rolling program. On the emergence side only the exit speed V is measured with a speed-measuring device 16, which can be designed identically as the speed-measuring device 15.

The traction with which the tube 13 is loaded in the zone of the individual roll stands 1–12 shown in the diagram underneath the roll stands 1–12. It is clearly evident that the full traction is not reached until beyond the roll stand 3 and is maintained only up to roll stand 10. The distance between these roll stands, which also represents the control zone, is designated by R. The stretching varies only within this zone if the total degree of drawing is modified with the aid of the adjustment device. The tensile stress on the tube 13 does not change within the zone of the traction-building roll stands 1–3 and the traction-diminishing roll stands 10–12.

Figure 2:
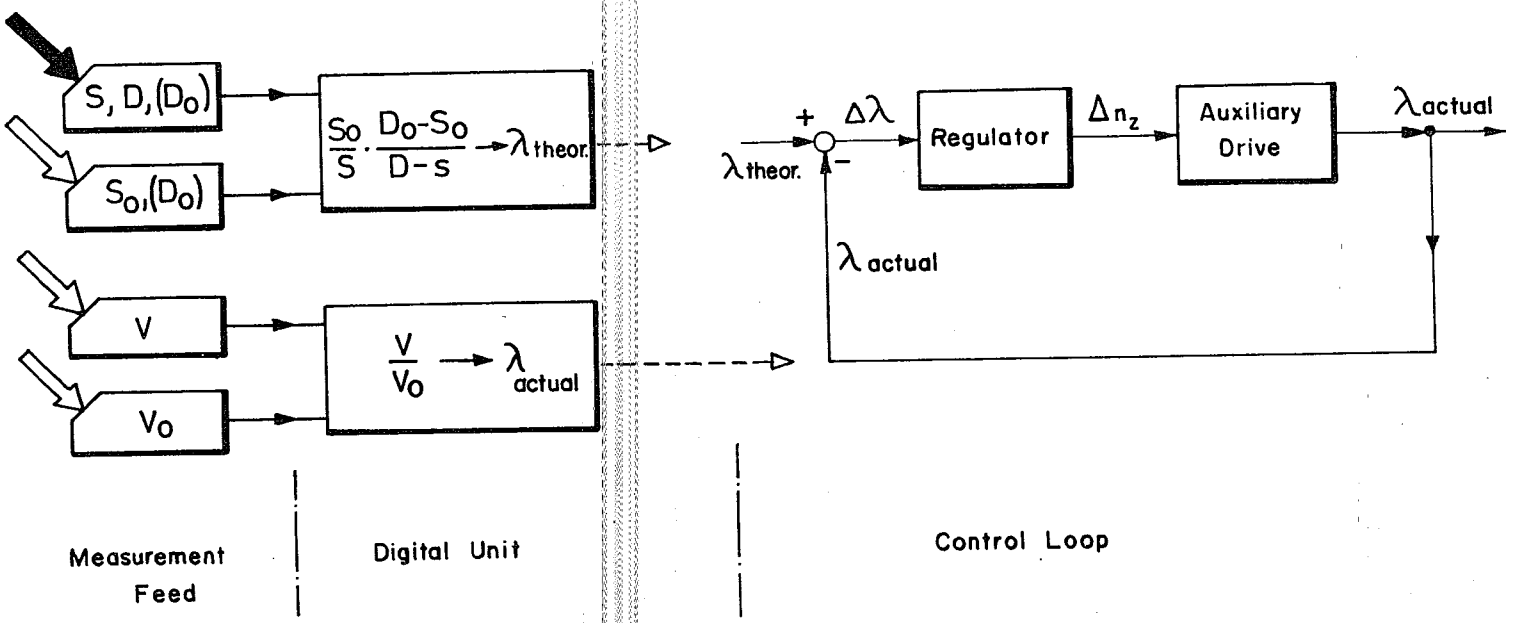
FIG. 2 shows a symbolic presentation of the processing of the measurement and feed values.

The measurement and feed values S, D, $S_o$ and $D_o$, which are determined or fed in on the entrance and exit sides accordingly to FIG. 1, are shown on the left in FIG. 2. The dark arrow symbolizes that a feed value is involved, while the light arrow designates the continuous measurement value. Because the external diameter of the entering tube can be either measured or fed in, its symbol $D_o$ is given in both boxes in parentheses.

The measurement and feed values S, D, $S_o$ and $D_o$ are transmitted to the digital unit shown on the right, which determines the theoretical stretching $\lambda_{theor.}$ from them. The digital unit determines the actual stretching $\lambda_{act.}$ from the measured speed values $V_o$ and V. The control loop is shown in the right-hand portion of FIG. 2, which shows how the two stretching values $\lambda_{theor.}$ and $\lambda_{act.}$ are compared with each other and the differences $\Delta\lambda$ in the two are conveyed to the regulator. From the stretching difference $\Delta\lambda$ the regulator determines the r.p.m. difference $\Delta n$ that is necessary in order to match the actual stretching $\lambda_{act.}$ to the theoretical stretching $\lambda_{theor.}$. The r.p.m. difference $\Delta n$ is used in the familiar group drive for a stretch-reduction rolling mill that consists of principal and auxiliary drive only for regulating the auxiliary drive, by which the r.p.m.'s of the rolls and thus the total degree of drawing can be varied in the required manner so that the actual stretching $\lambda_{act.}$ corresponds to the theoretical stretching $\lambda_{theor.}$.

When the beginning of the tube enters and the tube end emerges, that is, in the nonstationary operating state, one of the two speed measuring devices 15 or 16 is not in operation because no tube 13 is present at this location at this point in time. This means that the actual stretching $\lambda_{act.}$ cannot be calculated in the digital unit. One regulation possibility consists in maintaining the position of the regulator and thus the r.p.m.'s $n_z$ of the auxiliary drive as they were set by the preceding tube 13. Another possibility consists in maintaining only the actual stretching $\lambda_{act.}$ at the last value of the preceding tube section and comparing it with newly determined theoretical stretchings $\lambda_{theor.}$.

Figure 3:
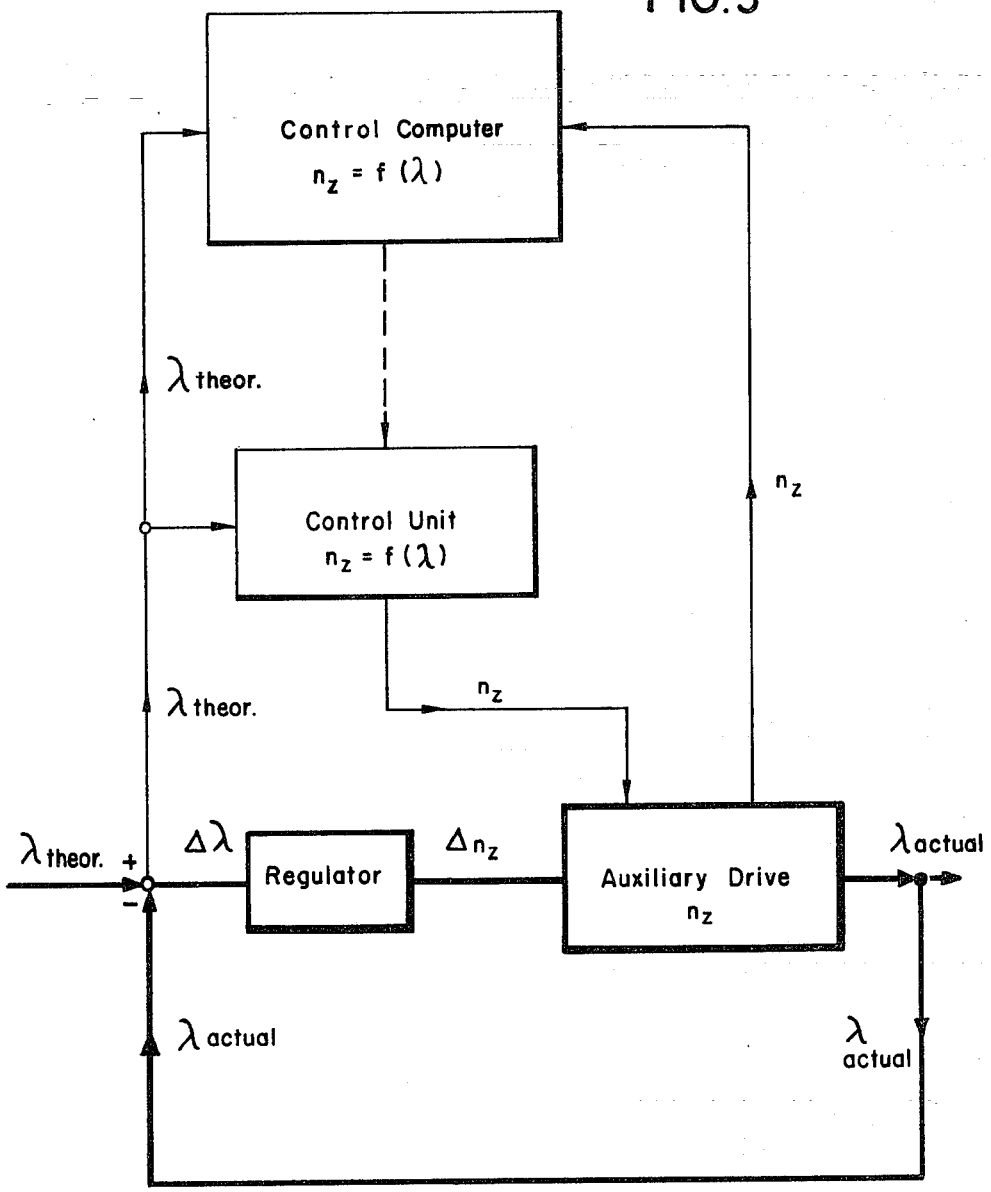
FIG. 3 shows the control loop according to FIG. 2 with an additional control system.

In the implementation form according to FIG. 3 the same control loop as in FIG. 2 is involved. It is designated by thick solid lines. The other symbols (not shown) for the measurement and feed values S, D, $S_o$ and $D_o$ as well as those for the digital unit are the same as in FIG. 2. A control system, which is assigned to the control loop, is also shown in FIG. 3 with thinner solid lines. This control system is required only because of the nonstationary operating state, in which the values measured on the entrance or exit side temporarily drop out. The control system has a control computer which receives the drive r.p.m. $n_z$ of the auxiliary drive and, during stationary operating conditions, also the theoretical stretching $\lambda_{theor.}$. From these values the control computer determines the dependence of the auxiliary r.p.m.'s $n_z$ on the theoretical stretchings $\lambda_{theor.}$ during the stationary operating state, from which a control law results for the computer which it continuously checks and possibly modifies. This takes place until the stationary operating state ends and the control loop is interrupted due to the lack of measurement values. In the case of an interruption of the control loop due to absence of the actual-stretching value during the nonstationary operating state a control unit functions in accordance with the information of the control law that the control computer determined during the stationary operating state. The control unit feeds the r.p.m.'s $n_z$ determined on the basis of the control law in the control computer into the drive of the rolling mill during the nonstationary operating state or as long as the control loop is interrupted. The control computer thus functions only when the control loop is closed, while the control unit functions only when the control loop is interrupted or open.

In a group drive with principal and auxiliary r.p.m.'s the auxiliary motor is adjusted directly in accordance with the r.p.m. difference $\Delta n_z$. In the case of individually driven roll stands this entails considerably greater expense because each individual r.p.m. must be regulated separately in this manner, a procedure which is however also possible.

In the foregoing specification we have set out certain preferred practices and embodiments of our invention;

however, it will be understood that this invention may be otherwise embodied within the scope of the following claims.

We claim:

1. Adjustment device for regulating the total degree of drawing of a multi-stand stretch-reduction rolling mill for the stretch-reduction of tube, by means of which the degree of drawing is adjustable as a function of the entrance measurements of the mean wall thickness of the tube in order to obtain a desired, uniform finished tube wall thickness, comprising means for measuring the wall thickness of a tube entering the stretch-reducing rolling mill and providing a signal relate to said wall thickness, means for measuring the speed of said tube entering the stretch-reducing rolling mill and providing a signal relate to said speed, means for measuring the speed of said tube leaving the stretch-reducing rolling mill and providing a signal related to said speed, a digital unit receiving said signals from the means for measuring wall thickness and the means for measuring entering speed and the means for measuring exit speed, a value for original diameter entering said stretching reducing mill and a value for desired final diameter, said digital unit calculating intermittently one of a desired and theoretical elongation ($\lambda_{theor.}$) from said wall thicknesses and external diameters of both the actually entering and desired finished tube sections and continuously calculating the actual elongations or stretchings ($\lambda_{act.}$) from the entrance and exit speeds ($V_o$,V) of the tube and regulator means adjusting the roll speeds r.p.m. (n) as a function of the differences in theoretical and actual elongation or stretchings ($\Delta\lambda$) present in a control loop, said regulator means receiving a control signal from said digital unit.

2. Adjustment device in accordance with claim 1, characterized in that said means for measuring wall thickness on the entrance side of the stretch-reducing mill is capable to measure the wall thicknesses ($S_o$) of successive tube sections, the lengths of which correspond to the tube volume in a controlled system (R) of the rolling mill, which extends from the first to the last of pass of said rolling mill, between which the tube is loaded with the full tension in the stationary operating state, and that the intermittent theoretical stretchings ($\lambda_{theor.}$) are determined by said digital unit for such a tube section, using said wall thickness ($S_o$) measurements.

3. Adjustment device according to claims 1 or 2, characterized in that said theoretical stretching ($\lambda_{theor.}$) of a tube section determined by the digital unit is the command variable for the regulator in the control loop if the middle of this tube section has reached the controlled system (R), i.e., the first of the pass, between which the tube is loaded with the full tension in the stationary operating state.

4. Adjustment device in accordance with claim 1 or 2, characterized in that storage means are provided at the regulator means whereby the last-determined and stored regulator adjustment can be used upon the entrance of the beginning of a tube and upon the emergence of the end of a tube.

5. Adjustment device according to claim 1 or 2 characterized in that storage means are provided at the regulator means whereby with the entrance of the beginning of a tube and with the emergence of the end of a tube the actual stretching ($\lambda_{act.}$) of the previously rolled tube section is still stored until the stationary operating state is reached and can be compared with the newly calculated theoretical stretching ($\lambda_{theor.}$) of the entering or emerging beginning or end of the tube, and whereby the roll r.p.m.'s (n) and thus the total degree of drawing ($\lambda$) can be regulated as a function of the differences in these theoretical and actual stretchings ($\Delta\lambda$).

6. Adjustment device according to claim 1 or 2, characterized in that a control system including a control computer is connected to the regulator and the control loop and the dependence of the actual regulator settings on the measured first-pass wall thicknesses ($S_o$) and the first-pass diameters ($D_o$) can be calculated with this computer during operation of the control loop in the stationary operating state, and that the roll r.p.m.'s (n) and thus the total degree of drawing ($\lambda$) can be controlled in the case of an interrupted control loop in the nonstationary operating state with the control system by means of the stored data from the control computer.

7. Adjustment device for regulating the total degree of drawing of a multi-stand stretch reduction rolling mill for the stretch reduction of tube which rolling mill has an entry end receiving a tube to be reduced and an exit end discharging a finished tube comprising means for measuring the tube wall thickness adjacent the entry end of said rolling mill, means adjacent the entry end measuring the speed of the tube entering the mill, means adjacent the exit end measuring the speed of the tube discharged from the mill, a digital means receiving the values from each of the thickness measuring means and the speed measuring means, means for feeding to the digital means the diameters of tube entering and discharged from the mill, means supplying to the digital means the wall thickness of the tube discharged from the mill, said digital means calculating intermittently one of the desired and theoretical stretchings ($\lambda_{theor.}$) from the wall thicknesses ($S_o$ and S) and the external diameters ($D_o$ and D) of the entering and desired finished tube sections and continuously the actual stretchings ($\lambda_{act.}$) from the entrance and exit speeds ($V_o$ and V) of the tube passing through the mill, drive means driving the rolling mill and regulator means receiving a signal from digital means which is a function of the differences in theoretical and actual stretchings ($\Delta\lambda$) and adjusting the drive to control the roll revolutions (n) as a function of $^{\Delta\lambda}$.

8. Adjustment device as claimed in claim 7 wherein the wall thickness measuring means is an isotope radiation meter and the speed-measuring means is in each case a measuring wheel connected to an impulse transmitter.

* * * * *

UNITED STATES PATENT AND TRADEMARK OFFICE

CERTIFICATE OF CORRECTION

PATENT NO. : 4,323,971

DATED : April 6, 1982

INVENTOR(S) : HERMANN MOLTNER and WOLFGANG SIEBENBORN

It is certified that error appears in the above-identified patent and that said Letters Patent are hereby corrected as shown below:

On the title page, under "Foreign Application Priority Data", the date should read --Nov. 23, 1979--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*